US006719673B1

(12) United States Patent
LaPlaca

(10) Patent No.: US 6,719,673 B1
(45) Date of Patent: Apr. 13, 2004

(54) CABLE SYSTEM FOR EXERCISE MACHINE WITH MULTIPLE EXERCISE STATIONS

(76) Inventor: Jack LaPlaca, 681 Rte. 23 South, Pompton Plains, NJ (US) 07444

( * ) Notice: Subject to any disclaimer, the term of this patent is extended or adjusted under 35 U.S.C. 154(b) by 0 days.

(21) Appl. No.: 10/270,422

(22) Filed: Oct. 15, 2002

(51) Int. Cl.[7] ..... A63B 21/062

(52) U.S. Cl. ..... 482/99; 482/93; 482/94; 482/98; 482/102

(58) Field of Search ..... 482/92–99, 102

(56) References Cited

U.S. PATENT DOCUMENTS 4,809,972 A * 3/1989 Rasmussen et al. ..... 272/118
6,565,490 B2 * 5/2003 O'Hearn ..... 482/102

* cited by examiner

*Primary Examiner*—Nicholas D. Lucchesi
*Assistant Examiner*—L. Amerson

(57) ABSTRACT

A multi-exercise station apparatus which, when not in use, has plural cables entrained about support pulleys to obviate slack and when a selected taut cable is pulled, a distal end thereof is effective to raise a weight from a weight stack for resistance, wherein the ballast of the weight stack provides said slack function and a pulley on said exercise stack provides said resistance function.

1 Claim, 1 Drawing Sheet

CABLE SYSTEM FOR EXERCISE MACHINE WITH MULTIPLE EXERCISE STATIONS

The present invention relates generally to a multi-station exercise machine and, more particularly, to a cable and pulley system with an optimum reduction in the pulleys which support the exercise weight-operating cable of the machine.

EXAMPLE OF THE PRIOR ART

An exercise machine which offers a variety of exercise routines operated from as many as five stations located about the machine and cable-connected to a centrally located weight stack, is already well known, as exemplified by U.S. Pat. No. 4,809,972 for "Exercise Machine With Multiple Exercise Stations" issued to Rasmussen et al. on Mar. 7, 1989. The routines are, of course, operated one at a time, using only one pull cable accessible at the selected exercise station, while the remaining four cable lengths not in use are supported on pulleys awaiting their turn in use at their cooperating four exercise stations. As is well understood, this is possible because of assigned functions to the pulleys, most for cable-guiding at stationary locations on the exercise machine support structure and interspersed therewith, a lesser number of exercise weight-controlling pulleys which "float" within the confines of the exercise machine support structure. The tradeoff in achieving multi-station exercise options in a single exercise machine, as in the '972 and other known patents, is the complexity of the cable and pulley support system, such as in the overall number of pulleys as dictated by the assigned functions needed during exercise use of the machine.

Broadly, it is an object of the present invention to overcome the foregoing and other shortcomings of cable and pulley support systems of a multi-station exercise machine.

More particularly, it is an object for a multi-station exercise machine to simplify in its exercise weight-operating cable system, at least in number, the pulleys providing the support needed for the cables, as well as providing other noteworthy benefits, all as will be better understood as the description proceeds.

Underlying this achievement is the recognition that the exercise weight stack can be used to advantage not just, as is self evident, as a resistance during the use mode of the machine, but also, as was not self evident, as a ballast to hold the cables taut, i.e., without slack, during non-use intervals.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
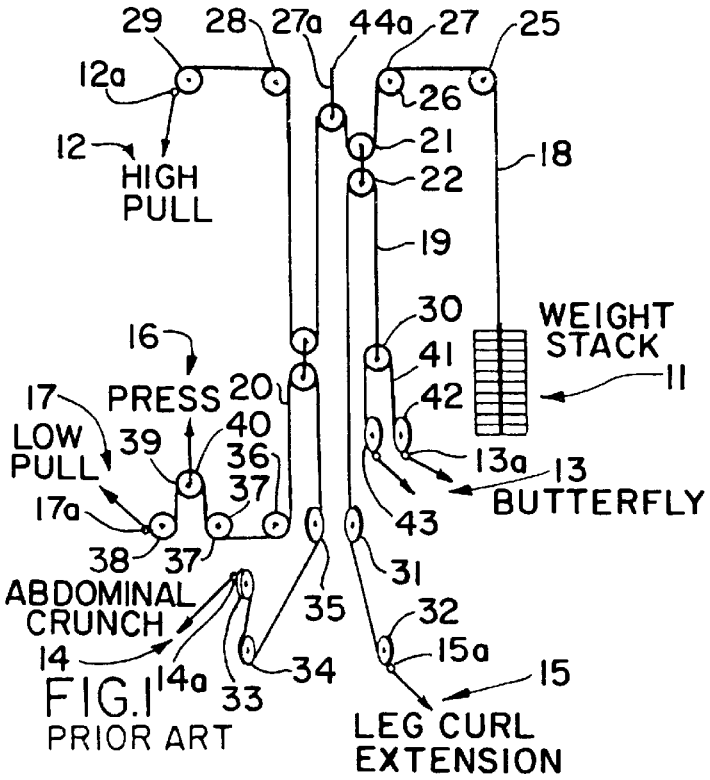
FIG.1 PRIOR ART
Figure 3:
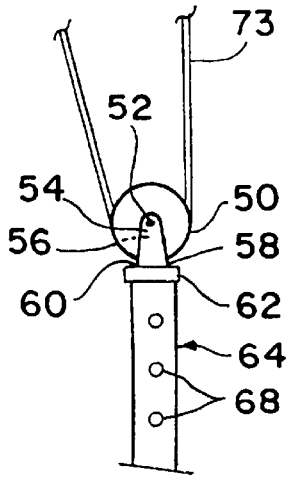
Figure 2:
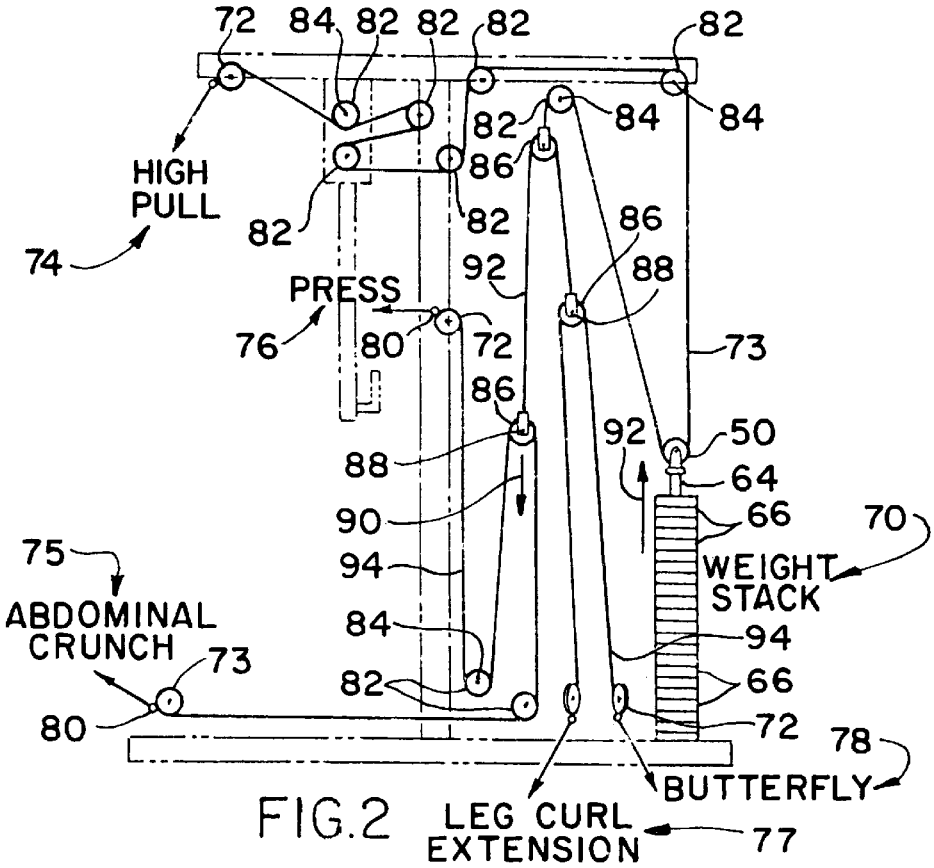

FIG. 1 is a schematic showing the cable and pulley system for the exercise machine of U.S. Pat. No. 4,809,972;

FIG. 2 is a similar schematic showing, but of an exercise machine cable and pulley system according to the present invention; and FIG. 3 is a partial side elevational view of a pulley component of the system of FIG. 2.

Exercise machines are in popular use in keeping with the trend to promote physical fitness, and share in common with each other cable and pulley systems for performing various exercise routines with exercise weights. An exemplary prior art cable and pulley system selected as appropriate background for understanding the present invention is that of U.S. Pat. No. 4,809,972 which is incorporated by reference herein pursuant to MPEP 2163.07(b), and illustrated in FIG. 1, and wherein further it will be understood that the pulley component of FIG. 3 is the patentable advance over the '972 and all other known patents.

For subsequent comparison to FIG. 2 incorporating the pulley component of FIG. 3, it is instructive to first refer to FIG. 1 showing that a cable 18 functions in conjunction with cables 19 and 20 by way of floating pulley sets 21–22 and 23–24, the two pulleys in each of these sets being coupled together. Cable 18 is guided by five guide pulleys 25–29 and passes beneath the floating pulley 21. The center pulley 27 is vertically adjustable, as noted at 27*a*, for slack take-up. Cable 19 passes over the floating pulley 22, is connected to a floating pulley 30, and is guided by guide pulleys 31–32. Cable 20 passes over floating pulley 24, is guided by six guide pulleys 33–38, and passes over a floating pulley 39 which is connected to the lower end of a cable component 40 of the press unit 16. Another cable 41 passes over the floating pulley 30 and is guided by guide pulleys 42–43.

The high pull unit 12 is connected to one end of the cable 18, the butterfly unit 13 is connected to the ends of cable 41, the leg curl extension unit 15 is connected to one end of the cable 19, and the abdominal crunch unit 14 and the low pull unit 17 are connected to the ends of cable 20. The cable component 40 and the cables 18, 19, 20 and 41, have ball-like stop fittings, 12*a*, 13*a*, 14*a*, 15*a* and 17*a*, respectively mounted thereon to restrict retraction thereof.

Significant by its absence in FIG. 1 is a cable-supporting and exercise weight-manipulating component of FIG. 3 consisting of a pulley, generally designated 50, journalled for rotation about an axle 52 supported between bifurcated arms 54 and 56 of a U-shaped bracket having a bottom 58 appropriately attached, as by welding at 60, to the top plate 62 of a weight-selecting rod 64 which, as is well understood projects, in use, into central aligned openings 66 of stacked exercise weights, individually and collectively designated (FIG. 2), and which rod 64 has a vertical array of through-bore openings 68, individually and collectively designated providing the exerciser with the option of inserting a pin (not shown) through a side opening (not shown) in a weight 66 effective to delineate from above the pin selected location the weights of the stack 70 that will be raised and will separate from the bottom weights of the stack 70 that will remain in place. Entrained about the pulley 50 to this end purpose is a cable length 73.

Underlying the present invention is the recognition that pulley 50 by its operative connection to the weight-selecting rod 64 provides the function of a described guide pulley(s) 25–29, 31–38 and also the function of a floating pulley(s) 21–24, 30–32, and thus achieves a corresponding reduction in an aggregate or overall number of pulleys needed for the exercise routines of a multiple exercise machine, all as will be better understood from the description which now follows of the schematic of FIG. 2.

A pulley, individually and collectively designated 72, is provided at each established exercise station or site 74, 75, 76, 77 and 78. Each pulley 72 has cable-direction control means, such as ball-like stop fittings, individually and collectively designated 80, to restrict retraction of cable entrained about the pulleys and to permit cable movement only in the direction of the directional arrows, a direction effective to raise selected weights 66 of the weight stack 70.

A select number of additional first plural pulleys, individually and collectively designated 82, are operatively disposed on appropriate support structure as illustrated in phantom perspective, in interposed positions between the established sites 75–78 and the weight stack 70, wherein each pulley 82 is characterized by being journalled for rotation about a cooperating axle 84 at a fixed, non-floating location on the exercise machine support structure.

Cooperating with the pulleys 82 is a select number of second plural pulleys, individually and collectively designated 86, also operatively disposed in interposed positions between the established sites 75–78 and the weight stack 70 and in interspersed relation with the pulleys 82, each pulley 86 being characterized by being journalled for rotation about a cooperating axle 88 movable in opposite either ascending and descending directions 90 and 92 along a vertical path, to provide the function of the previously described floating pulleys 21–24, 30–32.

Completing the FIG. 2 schematic are cable lengths, individually and collectively designated 94, which are in entrained relation about the pulleys 82 and 86 and in extended relation between each established site 75–78 and the exercise weight stack 70, and include a connection to the cable loop 73 shown in FIG. 3 effective, as is well understood, during exercising use of the exercise machine to enable pulling use of a cable 94 in the direction of a directional arrow to urge a selected number of weights 66 in ascending movement 90 from said exercise weight stack 70, and during non-exercising use to remain in a taut condition extended between the cable-direction control means 80 and weight stack 70 to thereby obviate any discernable slack in the cable lengths 94.

From the foregoing descriptions of the FIGS. 1 and 2 schematics, it should be readily appreciated that an overall reduction of pulleys has been achieved by using to advantage the opposite direction movement of the rod-supported pulley 50 which imparts the floating pulley function thereto and, of course, when no weight is being raised, the in-place condition of the stack 70 to which the rod 64 is connected is a ballast for the stops 80 to obviate any slack in the cable 94.

While the exercise machine cable and pulley system herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An exercise device comprising, in combination,

A. plural means of a selected number establishing sites for partaking of exercise routines;

B. a pulley at each said established site characterized by having a cable-direction control means effective to permit a cable movement only in a pulling direction;

C. an exercise weight stack;

D. a select number of first plural pulleys operatively disposed in an interposed position between each said established site and said exercise weight stack characterized by being journalled for rotation about an axle means at a fixed location;

E. a select number of second plural pulleys operatively disposed in an interposed position between each said established site and said exercise weight stack characterized by being journalled for rotation about an axle means movable in opposite either ascending and descending directions along a vertical path;

F. cable lengths disposed in extending relation between each said established site and said exercise weight stack and in entrained relation about said first and second pulleys;

G. an exercise weight stack pulley operative disposed in a supported position atop said exercise weight stack characterized by having an exercise weight-lifting cable length entrained thereabout;

H. a first operative position of said exercise weight stack pulley during non-use of said exercise weight effective to hold said cable lengths taut between said cable-direction control means and said exercise weight stack;

I. a second operative position of said exercise weight stack pulley during use of said exercise device in ascending movement to impart correspondingly ascending movement to an exercise weight;

whereby the singular exercise weight stack pulley by assuming said first and second operative positions obviates the use of two pulleys and reduces the overall number of said first and second pulleys of said exercise device.

* * * * *